United States Patent [19]

Sasamori

[11] 4,184,671

[45] Jan. 22, 1980

[54] AUTOMATIC DOCUMENT HANDLER IN DUPLEX COPYING MACHINE

[75] Inventor: Yusuke Sasamori, Tokyo, Japan

[73] Assignee: Rank Xerox Limited, London, England

[21] Appl. No.: 884,332

[22] Filed: Mar. 7, 1978

[30] Foreign Application Priority Data

Mar. 15, 1977 [JP] Japan ..... 52-27552

[51] Int. Cl.[2] ..... B65H 3/00

[52] U.S. Cl. ..... 271/18; 271/35; 271/117; 271/122; 355/3 R; 355/23

[58] Field of Search ..... 355/3 R, 14, 23, 26, 355/24, 133; 271/4, 65, 3.1, 8 R, 8 A, 18, 34, 35, 124, 122, 18.1, 18.2, 9, 90, 91, 94, 97–99, 111, 117, 118, 162, 163, 164, 165, DIG. 9

[56] References Cited

U.S. PATENT DOCUMENTS

| | | | |
|---|---|---|---|
| 2,979,329 | 4/1961 | Cunningham | 271/98 |
| 3,700,231 | 10/1972 | Aasen et al. | 271/65 X |
| 4,053,152 | 10/1977 | Matsumoto | 271/8 A |
| 4,066,252 | 1/1978 | Wick | 271/65 |
| 4,080,060 | 3/1978 | Nothmann | 355/23 |

OTHER PUBLICATIONS

*Research Disclosure,* "Apparatus for Producing Collated Copies in Page Sequential Order", pp. 80–82, Apr. 1977.

*Primary Examiner*—R. L. Moses

[57] ABSTRACT

A copy reproduction machine having an automatic document handler adapted for top feeding or botton feeding documents from the document supply tray. An inverter is also provided so that, depending on the machine operating mode selected, i.e. simplex (one sided) document to simplex copy, simplex document to duplex (two sided) copy, duplex document to simplex copy and duplex document to duplex copy; the documents are returned to the stacking tray in the proper page order.

6 Claims, 13 Drawing Figures

AUTOMATIC DOCUMENT HANDLER IN DUPLEX COPYING MACHINE

BACKGROUND OF THE INVENTION

This invention concerns an automatic document handling apparatus for an electrophotographic reproduction machine.

Conventional electrophotographic reproduction machines comprising a reproduction machine capable of automatically transferring images on both surfaces of a copying paper in combination with an automatic original feeding apparatus have been constituted as shown in FIG. 1.

Referring at first to the operation of the reproduction machine main body by way of FIG. 2, an original document 2 placed on a platen glass 1 is illuminated from an exposure lamp 3. Images from the original 2 are projected by way of a lens 4 and mirrors 5*a* and 5*b* to a photosensitive drum 6. The photosensitive body 6 deposited with static charges by a corotron 7 rotates counter clockwise and electrostatic latent images are formed on the photosensitive body 6 when the images from the original 2 are projected thereto through a slit 8. The lens 4 moves in the direction of an arrow A in time with the rotation of the photosensitive body 6 and produces electrostatic latent images of the original 2 on the photosensitive body 6. The electrostatic latent images are developed into toner images by a developer 9 and transferred onto copy sheets 10 fed in synchronism with the toner images by way of a transfer corotron 11. The toner images on the copy sheets 10 are fixed in a fixer 12 and then the copy sheets are discharged on a copy receiving tray 13. Since the copy sheets are discharged with the copied surface up, an advantage is obtained in that the finished state of the reproduction can be checked instantly.

However, where the reproduction is to be effected for a set of documents consisting, for example, of three original sheets comprising a first page $P_1$ through a third page $P_3$ and the first $P_1$ is placed on the platen for the copying operation first, followed by the operation for the second and the third sheets successively, the copy sheets 10 are deposited on the copy receiving tray 13 in an order in which the third sheet $P_3$ comes uppermost of the stack as shown in FIG. 3. Accordingly, in using the set of copied sheets, the paper stack should be re-ordered after taking out the copy sheets 10 from the tray 13, which is a great inconvenience, particularly for a large number of pages.

While the above description relates to the transfer only on one side of the copy sheets, explanation will now be made to the operation where transfer is effected on both sides of the copy sheets.

In FIG. 2, depression of a switch for duplex copying mode (not shown) on a console, displaces a part 15 of a copy sheet conveying mechanism from position B to B', which is carried out by energizing a solenoid (not shown). A paper feed roller 17*b* is supported by an arm around a pivot on a paper feed tray 16*b* and the paper feed roller 17*b* rises from a position C to a position C' as the conveying mechanism 15 moves from the position B to the position B'.

When the reproduction machine is operated in this state, copy sheets are fed from the paper feed tray 16*a* by the paper feed roller 17*a* and accumulated on the paper feed tray 16*b*, wherein toner images are fixed on the upper surface of the copying sheets.

Where a set of originals consisting, for example, of a first page $P_1$ through sixth page $P_6$ are to be reproduced and the reproduction is effected in the order of the first page $P_1$, the third page $P_3$ and the fifth page $P_5$, the copy sheets are accumulated on the paper feed tray 16*b* as shown in FIG. 4. Then, by deenergizing the solenoid to return the conveying mechanism to the position B, the paper feed roller 17*b* descends on the stack of the copying sheets by its own weight. When the originals are placed on the original platen in the order of the second, fourth, and sixth pages successively, and subjected to reproduction, copies can be obtained on the copy receiving tray well-arranged from the sixth page as shown in FIG. 5. Consequently, the stacked copies can be taken out and used as they are with no re-ordering.

As is evident from the foregoing, the order of the copied sheets deposited on the copy receiving tray differ between single side reproduction and duplex reproduction, which is very inconvenient in actual use.

In order to overcome this inconvenience, an inverter 18 as shown in FIG. 6 and FIG. 7 has been provided, so that copy sheets discharged from the reproduction machine main body are turned upside down to re-arrange the order of the copy sheets to the original order.

The provision of such an additional mechanism in the conveying passageway for the copy sheet, however, results in serious inconvenience in that it increases the probabilities of copy sheet jams, as well as increases the time for sheet travel from the start of the reproduction machine to the discharge of the copy sheets to the copy receiving tray due to the increase in the full length of the conveying passageway.

This invention has been made in view of the foregoing and the object thereof is to provide an automatic document handling apparatus in an automatic document sending apparatus for automatically feeding documents to an exposure station of a reproduction machine and automatically discharging the original sheets after exposure, characterized by the provision of an automatic original document feeding mechanism for continuously feeding originals from the last original sheet when the transfer is to be effected only on one side of the copy sheets and from the first original sheet when the transfer is to be effected on both sides of the copy sheets upon receipt of signals in accordance with a one side reproduction or a duplex reproduction mode from the reproduction machine main body thereby enabling use of the copy sheets as they are delivered to the output tray of the machine. A further object of this invention is to provide an automatic document handling apparatus having an automatic document discharging mechanism wherein, after the feeding of an original to the exposure station of a reproduction machine, the succeeding original is fed and, simultaneously, the direction of discharging the original already present at the exposure station to the original receiving trays is selected in accordance with the direction of feeding the originals, whereby the order of the originals are returned to the initial order when all of the exposed originals are accumulated on the original receiving tray.

SUMMARY

An automatic document handling apparatus including a document feeding station for feeding originals in different feeding orders depending upon the case whether transfer is effected only on one side of a transfer material to be transferred with images or on both sides thereof, an exposure station for the exposure of documents fed from the document feeding station, a document discharging station for discharging the documents received from the exposure station as they are or inverting them and control means for controlling the feeding order of the documents, as well as for the selective control of the orientation to provide documents directly to the discharge station or to invert the documents prior to discharge.

DESCRIPTION OF THE PREFERRED EMBODIMENT

Figure 8:
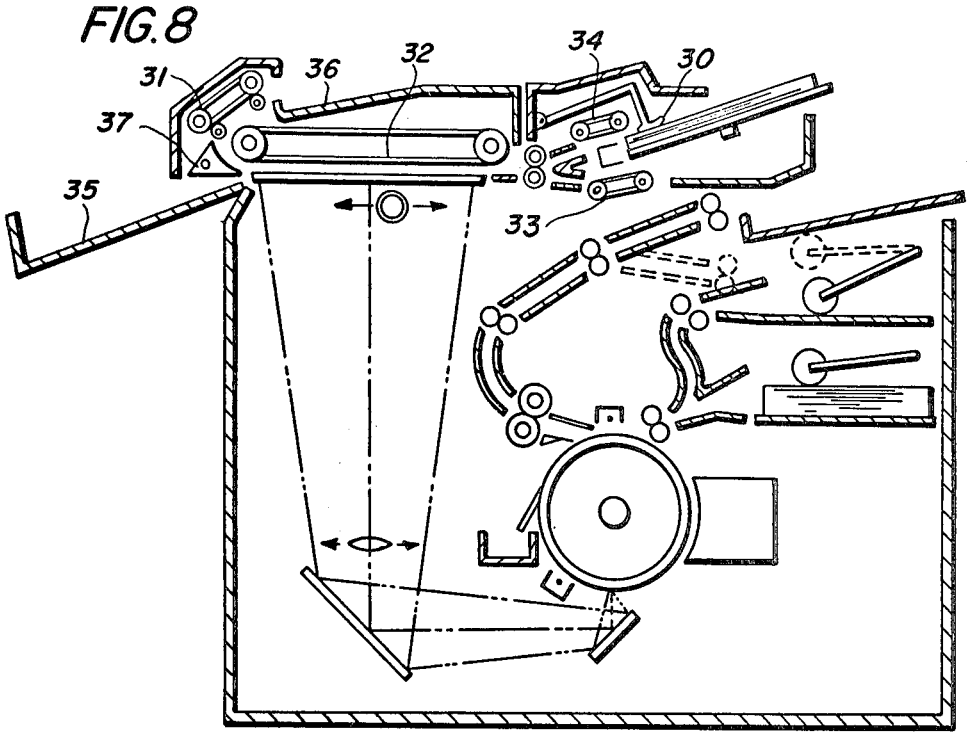

This invention is to be described hereinafter referring to FIGS. 8 through 13. Referring to FIG. 8, the automatic original handling apparatus according to this invention comprises an original feeding station 30, an original discharging station 31 and an exposure station 32. The original feeding station 30 is provided therein with a first driving device 33 for feeding the originals from the lowermost sheet of the stacked originals with the surfaces to be exposed being turned down and a second driving device 34 for feeding the originals from the uppermost sheet of the stacked originals. The original discharging station 31 is provided therein with a first original receiving tray 35 for receiving the originals discharged directly from the exposure station 32 and a second original receiving tray 36 for receiving the originals discharged from the exposure station 32 while inverting them and a switching pawl 37 for directing the originals so that they are discharged selectively to one of the original receiving trays.

Figure 1:
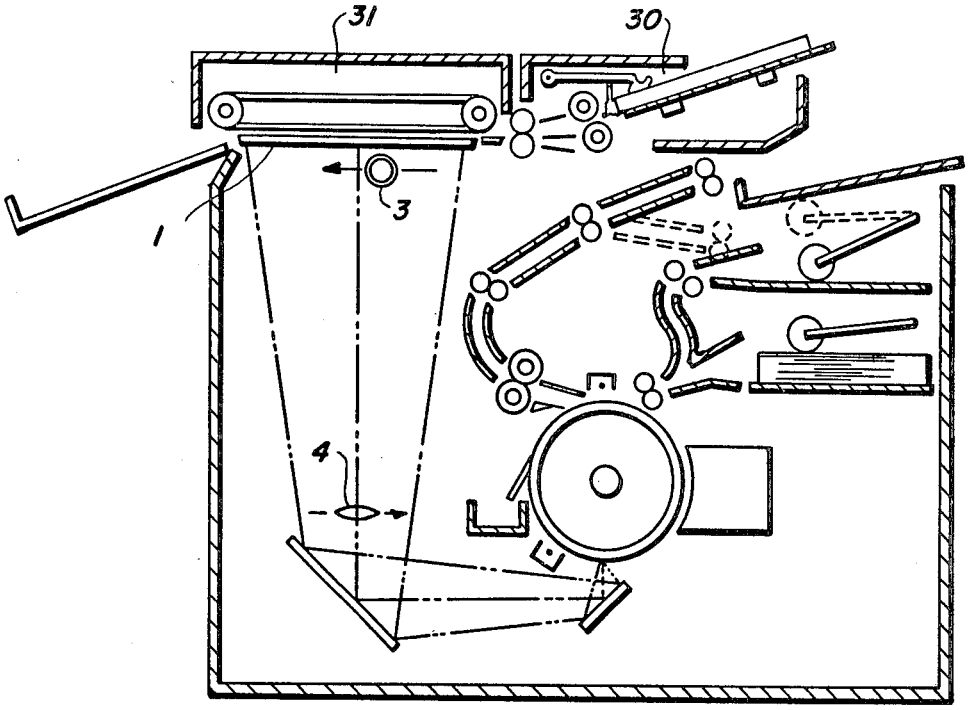
FIG. 1 PRIOR ART
FIG. 1 is an explanatory view for the construction of an electronic reproduction machine having an automatic duplex reproducing mechanism with a conventional automatic original feeding device.
Figure 2:
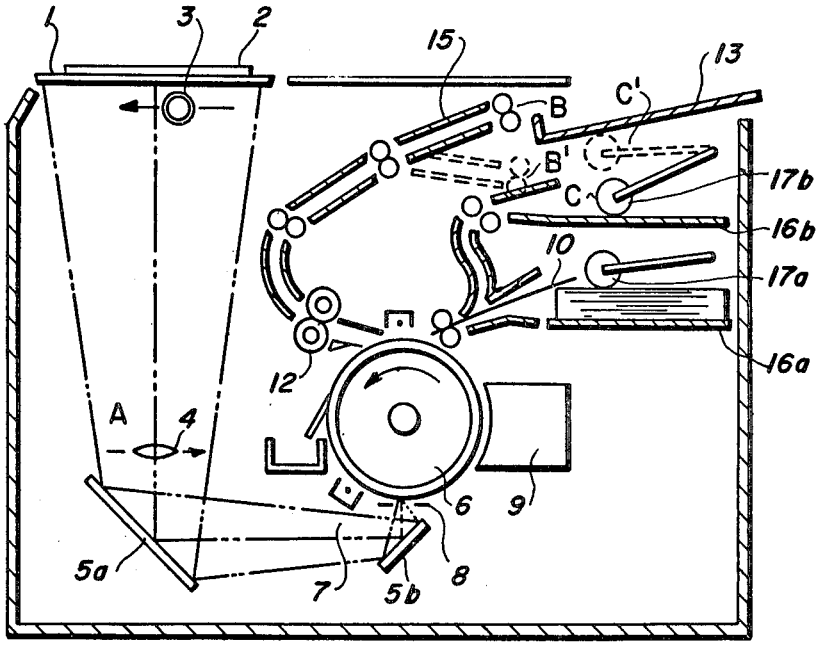
FIG. 2 PRIOR ART
FIG. 2 is an explanatory view for the construction of the electronic reproduction machine having an automatic duplex reproducing mechanism.

The automatic original handling apparatus having the foregoing construction handles the original sheets on receiving signals indicative of the reproduction modes from the reproduction machine main body as shown in FIG. 1.

| | | State of Originals | | | | | |
|---|---|---|---|---|---|---|---|
| | | Where images are to be transferred only on one side of the original | | Where images are to be transferred on both sides of the originals | | | |
| | | | | First feeding | | First feeding | |
| Copy mode in copying machine main body | Transfer only on one side | Original feeding order Feeding from the uppermost sheet | Original discharging direction Discharging the originals turning upside down | Original feeding order Feeding from the lowermost sheet | Original discharging direction Discharging the originals turning upside down | Original feeding order Feeding from the lowermost sheet while leaving the original set discharged in the first feeding as it is | Original discharging direction Discharging the originals while turning upside down |
| | Transfer on one side and thereafter on the other side | Feeding from the lowermost sheet | Discharging the originals without turning upside down | Feeding from the uppermost sheet | Discharging the originals without turning upside down | Feeding from the uppermost sheet while leaving the original set discharged in the first feeding as it is | Discharging the originals without turning upside down |

Figure 12:
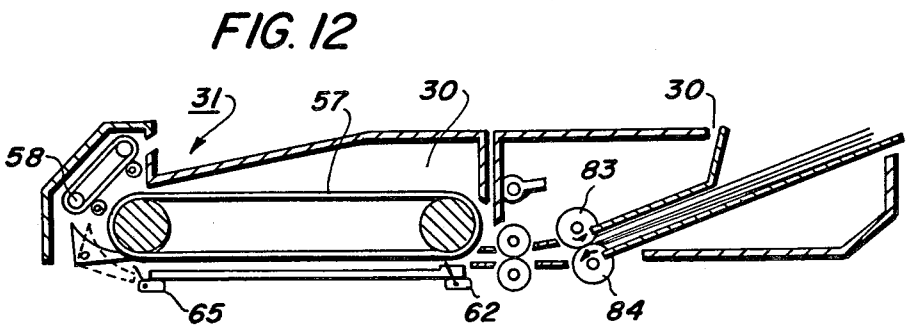
Figure 13:
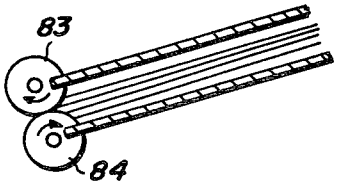
Figure 3:
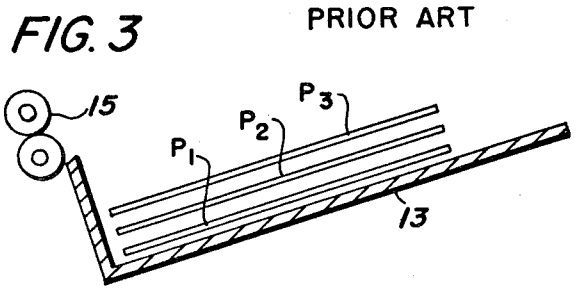
FIGS. 3 through 5 are explanatory views showing the order of the transfer sheets and the orientation of the copy sheets discharged from the reproduction machine.
Figure 5:
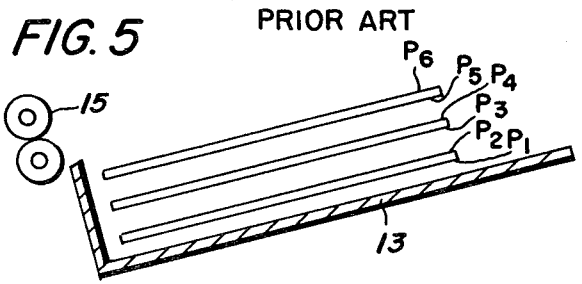
Figure 4:
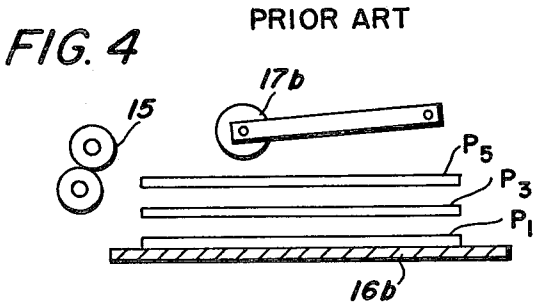
Figure 6:
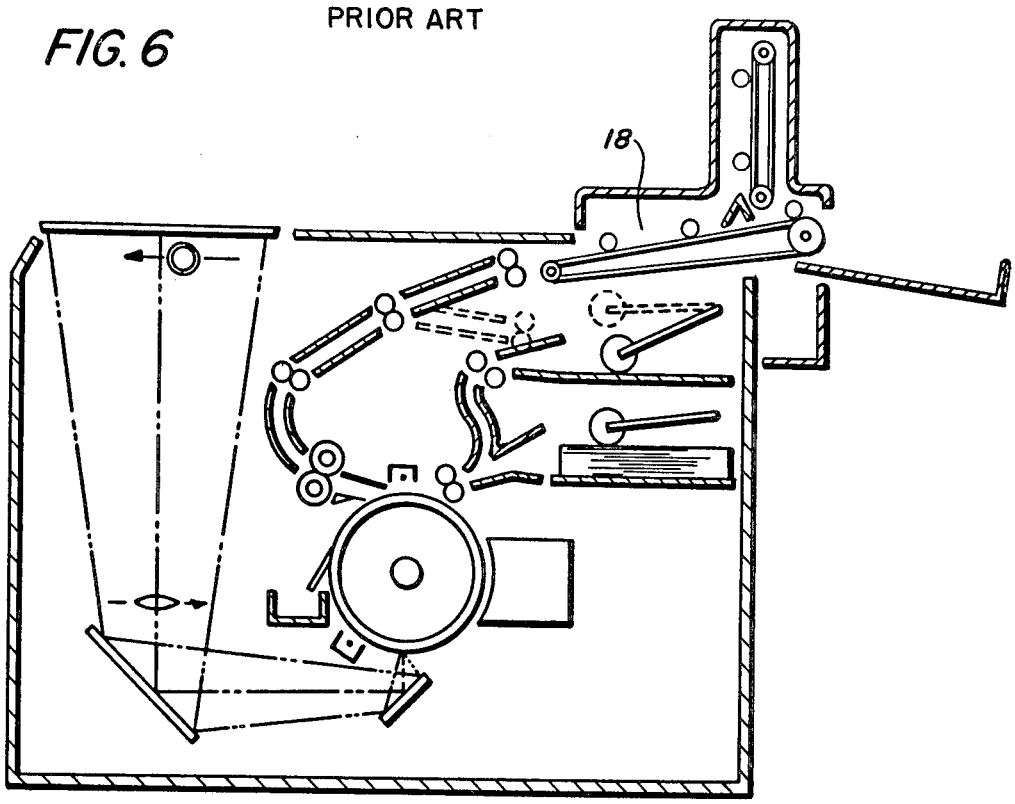
FIG. 6 PRIOR ART
FIG. 6 is an explanatory view for the construction of an electronic reproduction machine having an inverter.
Figure 7:
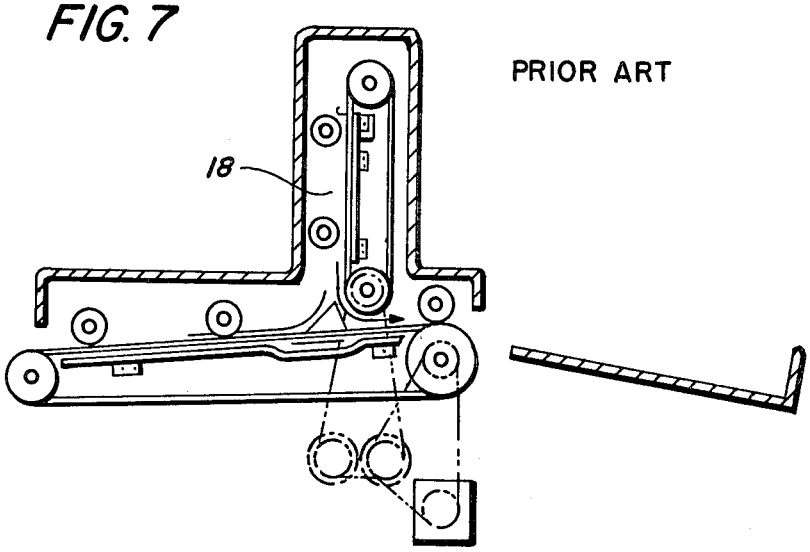
FIG. 7 PRIOR ART
FIG. 7 is an explanatory view for the construction of the inverter.
Figure 9:
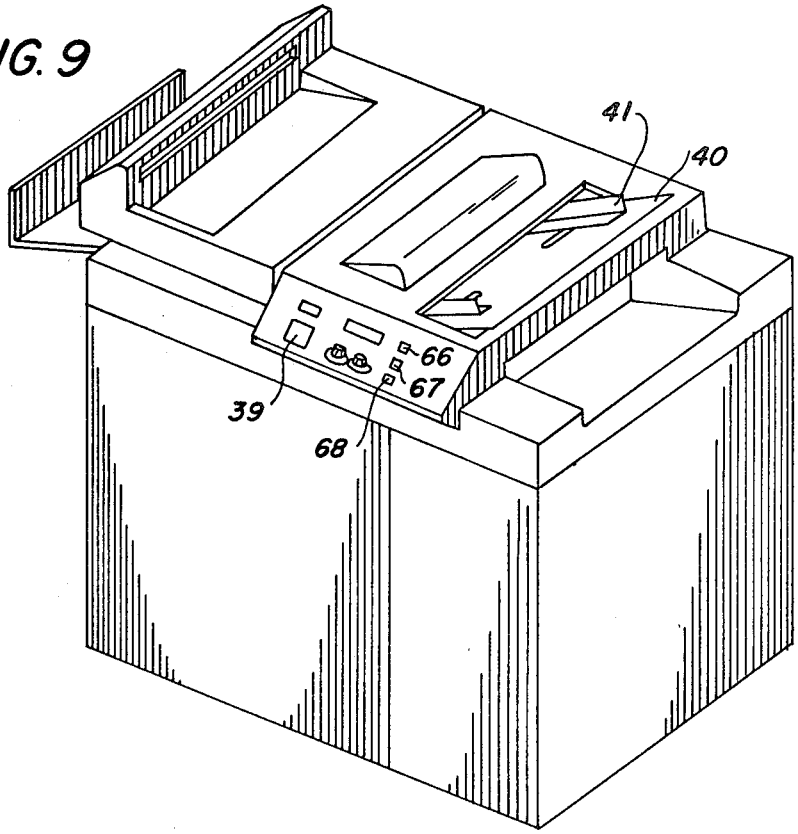
Figure 10:
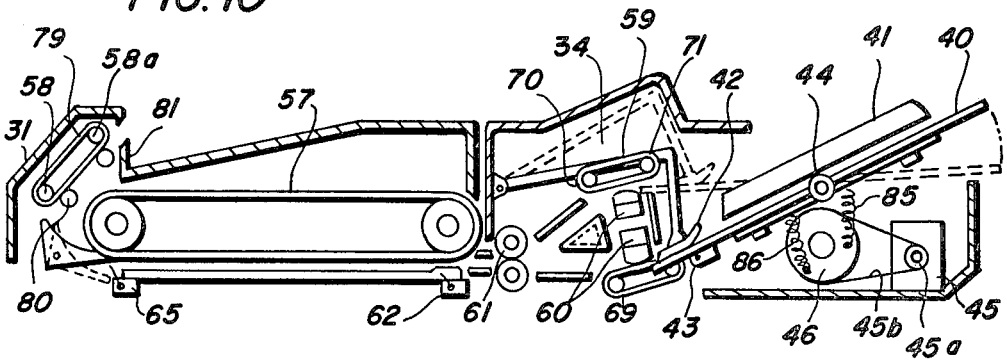
Figure 11:
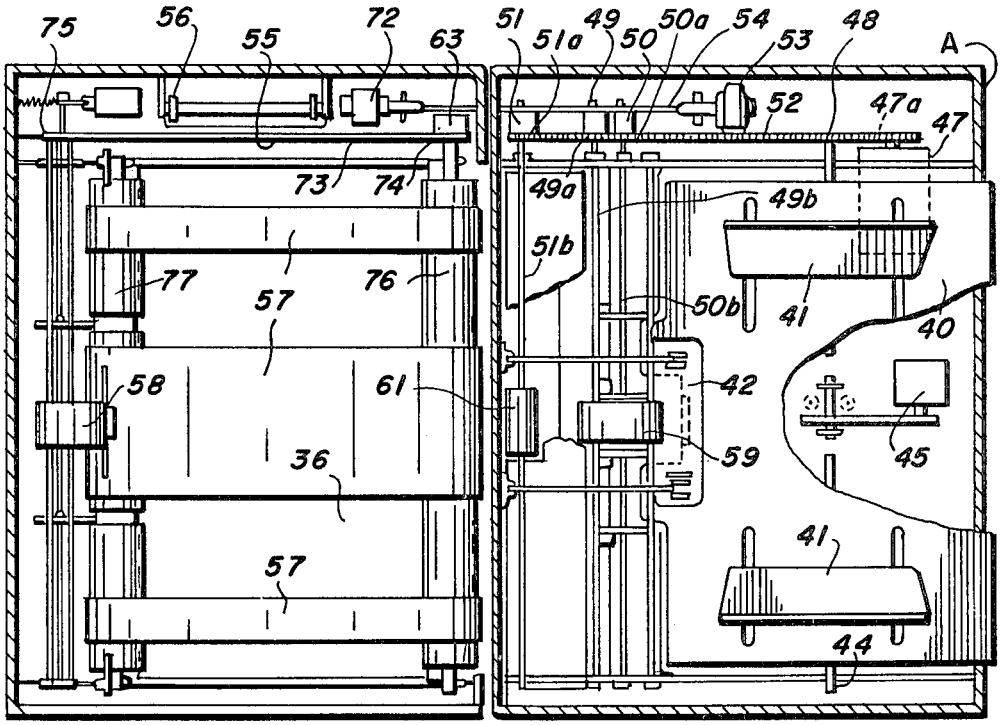

FIG. 8 is an explanatory view for the construction of an electronic reproduction machine having an automatic original feeding apparatus as one embodiment of this invention, FIG. 9 is a perspective view of the embodiment of FIG. 8, FIG. 10 is a longitudinal sectional view for one embodiment of this invention, FIG. 11 is a partially cut away plan view thereof, FIG. 12 is a longitudinal sectional view of another embodiment of this invention and, FIG. 13 is an explanatory view where the original is fed from the top of the sheet stack in the original feeding station.

Referring to FIGS. 9, 10 and 11, the automatic original handling apparatus comprises a tray 40 for loading thereon the documents to be fed. The tray 40 is provided with a pair of guide members 41 each having a flat base and a vertical side plate. The guide members 41 are mounted on slots in the tray and adjustable to accomodate various sizes of documents.

A stack of documents to be copied is placed on the tray 40 with the surfaces to be reproduced facing downward and inserted to the inside between a retention plate 42 and the tray 40 until a switch 43 is actuated. The switch 43 is actuated upon depression of an actuation piece by the deposition of the documents and confirms the insertion of the document stack to a predetermined position. When all of the documents to be reproduced have been fed, the switch is deactuated and produces a signal indicative of the absence of documents to be fed to the reproduction machine.

The tray 40 is pivotally mounted to a frame A of the main body by way of a pivot 44. The body frame A pivotally supports a pulley 46 which is connected to a pulley 45*a* of a rotary solenoid 45 by way of a belt 45*b*. The tray 40 is connected to the pulley 46 by way of springs 85 and 86.

In the drawing, reference numerals 49, 50 and 51 respectively represent clutches whose sprockets 49*a*, 50*a* and 51*a* at the input side and a sprocket 52 are connected to a sprocket 47*a* of a main motor 47 by way of a chain 48. The output sides of the clutches 49, 50 and 51 are connected to shafts 49*b*, 50*b* and 51*b* respectively. The shafts 49*b* and 50*b* are provided with pulleys 70 and 71 which in turn are provided with a first feed belt 59. With the above arrangement, a first driving device 34 is constituted. The shaft 51*b* of the clutch 51 is provided with a feed roller 61. Numeral 60 in the drawing represents a retention member.

The above sprocket 52 is connected to the input side of a gear train 53 whose output side is connected to the input side of a gear train 72 by way of a shaft 54. The gear train 72 is provided, at the output side thereof, with a sprocket 73, which is connected by way of a chain 55 to a sprocket 74 of a clutch 63 and to a sprocket 75. A pulley 76 is mounted to the output side of the clutch 63 and a pulley 77 is supported to the body frame A in parallel with the pulley 76. A discharge belt 57 is mounted between the two pulleys 76 and 77. A discharge pulley 58 is mounted to the shaft 78 of the above sprocket 75 and a belt 79 is provided on the discharge pulley 58 and a pully 58*a* supported to the body frame A. Rollers 80 and 81 contact the belt 79.

The cover for the discharge station 31 is openably supported by a hinge on one side of the body frame A. The openable structure of the cover provides a great advantage for removal of jams in feeding documents and for partial reproduction of the documents without using the original handling apparatus.

Considering the operation of the foregoing device, upon pushing the start button 39, the rotary solenoid 45 turns clockwise to a predetermined angle thereby turning the pulley 46 and thus turning the tray 40 by way of the springs 85 and 86 clockwise to the position shown by dotted lines in FIG. 10.

Simultaneously with the start of the rotation of the rotary solenoid 45, the main motor 47 is actuated. The main motor 47 drives each of the clutches 49, 50 and 51 by way of the chain 48, rotates the sprocket 73 by way of the sprocket 52, the gear train 53, the shaft 54 and the gear 72 and rotates the clutch 63 and the sprocket 75 by way of the chain 55. Consequently, the original discharging belt 57 and the discharging roller 58 are also driven.

When the clutches 49 and 51 are connected after a predetermined period of time from the starting of the main motor 47, the second driving device 34 is rotated and the uppermost original is fed by the frictional force between it and the first feed belt 59. The above retention member 60 serves to feed only the uppermost sheet even if two or more originals tend to be fed together. The original thus fed is further advanced by the feed roller 61 to actuate the original detection switch 62. Actuation of the switch 62 deenergizes the clutch 49 and energizes the clutch 63. The original at switch 62 is further advanced by way of the feed roller 61 and the belt 57. When the trailing end of the original passes the switch 62, the switch 62 is opened to stop the main motor 47. At the stop of the main motor 47, scanning exposure of the reproduction machine is started and the scanning is repeated for predetermined number of cycles. After the predetermined cycles of scanning have been completed, the main motor 47 is again energized to discharge the original from the exposure station 32 out side of the machine by driving the belt 57.

At discharge, the solenoid 65 is energized or denergized so as to discharge the original as shown in table 1 in accordance with the predetermined types of originals and the copy modes of the reproduction machine and the originals are discharged either to the first original receiving tray 35 or to the second original receiving tray 36.

When the switch 64 is actuated on discharging the original, the clutch 49 is again energized to start feeding the second original sheet and thus the operation is continued in the foregoing sequence to feed all of the originals. When the last original sheet is fed and the switch 43 is deactivated, the clutch 49 is not energized if the switch 64 is actuated at the discharge of the final original sheet after the exposure process and the main motor 47 stops after rotation up to the discharge of the final original sheet, whereby all of the clutches are deenergized and the apparatus of this invention is in a stand-by state.

While the above descriptions have been made to the operation for transferring the images to be reproduced on one side of the originals to one side of the copy sheets, the original sheets should be fed from the lowermost original in the original stack inserted into the tray 40 where transfer is to be made in the state of the original shown in the table 1 and for transferring images on both sides of the copy sheets.

The following description will illustrate the feeding of originals from the lowermost original sheet. The operation for sending the original from the lowermost one is selected in accordance with the table 1 by the selective combination between a state selection switch 66 and a reproduction mode selection switch 67 shown in FIG. 9. When starting the feeding from the lowermost original, the solenoid 45 is not energized with the depression of the start button 39 and the lowermost sheet of the originals on the tray 40 is kept in contact with the feed belt 69 of the driving device 33. Since the stack of the original is pressed by the original retention plate 42, the lowermost sheet is fed by the frictional force between the feed belt 69 and the surface of the original by the rotation of the feed belt 69. When the start button 39 is depressed, the main motor 47 starts to rotate and the clutch 50 is energized after a predetermined period to rotate the feed belt 69, thereby feeding the lowermost original. The operational sequence after the feeding of the original has started is just the same as in the feeding of the uppermost original sheet excepting that the clutch 50 instead of clutch 49 is energized.

In the above embodiment of this invention, the original driving device is shown as two separate stations of first and second original driving devices for feeding the originals from the uppermost sheet and the lowermost sheet of the original stack respectively. In the embodiment illustrated in FIGS. 12 and 13, the original can selectively be fed from the uppermost or the lowermost of the stack by changing the direction of rotation in a pair of feed rollers 83 and 84 as shown in FIG. 12 closely related and circumferentially rotating to each other using one of the pair as the discharging roller and the other as the feed roller, which is disclosed, for example, as a pair of feed rollers of an automatic original feeding apparatus in Japanese Patent Publication No. 25739/1976.

In the reproduction machine of a type wherein copy sheets are discharged from the machine with the copied surfaces down, it is apparent that the feeding order for the originals can be altered in accordance with the state of the copy sheets.

Since the present invention comprises, as detailed above, an original feeding station provided to the body frame A of the apparatus for feeding the originals in different order depending upon the case whether the transfer is effected only to one side of transfer material to be transferred with images or to both sides thereof, an exposing station 32 for the exposure of the originals fed from the original feeding station 30, an original discharging station 31 for discharging the originals discharged from the exposing station 32 as they are inverting them, and selection switches for controlling the feeding order at the feeding of the originals as well as for selectively controlling the discharging direction whether to discharge the originals as they are or to discharge them inverted, the originals are fed in the different orders depending upon the case whether the transfer is effected only to one side of the transfer material to be transferred with images or to both sides thereof and the discharging direction of the exposed originals from the exposing station 32 to the original receiving tray is selected to discharge sheets directly or to discharge sheets inverted in accordance with the feeding order of the originals and whether the originals carry the images to be transferred on one side or both sides thereof, whereby the order of the originals accumulated on the original receiving tray can be rearranged to the initial order of the originals when all of the exposure processes have been completed.

What is claimed is:

1. An automatic document handling apparatus for use with a document reproduction machine comprising a document tray adapted for holding a stack of documents to be fed to the reproduction machine for copying document feed means associated with said document tray adapted to feed documents from the top or the bottom of the document stack depending upon whether one or both sides of the documents are to be copied.

2. An automatic document handling apparatus according to claim 1 wherein said document feed means includes a first sheet feed means located adjacent said document tray in a position to feed the bottom document in the tray and a second sheet feed means located adjacent said document tray in a position to feed the top sheet in the document stack.

3. An automatic document handling apparatus according to claim 2 further including means to vary the position of said document tray to maintain the bottom sheet in the tray in contact with said first sheet feed means when documents are to be fed from the bottom of the document stack and to maintain the top sheet in the document stack in contact with said second sheet feed means when documents are to be fed from the top of the stack.

4. An automatic document handling apparatus according to claim 1, wherein said document feed means includes a pair of upper and lower counter rotating, reversible feed rolls located adjacent said document tray, rotation of the lower feed roll in a forward direction and the upper feed roll in a reverse direction causing documents to be fed from the bottom of the stack, rotation of the upper feed roll in a forward direction and the lower feed roll in a reverse direction causing documents to be fed from the bottom of the stack.

5. An automatic document handling apparatus according to claim 2 further including a first and second document discharge tray suitably positioned in said document handler such that discharge of documents into said first tray causing said documents to be stacked therein face down, discharge of documents into said second tray causing said documents to be stacked therein face up.

6. An automatic document handling apparatus according to claim 4 further including a first and a second document discharge tray suitably positioned in said document handler such that discharge of documents into said first tray causing said documents to be stacked therein face down, discharge of documents into said second tray causing said documents to be stacked therein face up.

* * * * *